United States Patent [19]

Lavalerie et al.

[11] 4,383,500

[45] May 17, 1983

[54] DRYING UNIT FOR A STEAM GENERATOR ESPECIALLY IN NUCLEAR REACTORS

[75] Inventors: Claude Lavalerie, Taverny; Christian Borrel, Carriere, both of France

[73] Assignee: Framatome, Courbevoie, France

[21] Appl. No.: 272,443

[22] Filed: Jun. 10, 1981

[30] Foreign Application Priority Data

Jul. 2, 1980 [FR] France ..... 80 14744

[51] Int. Cl.[3] ..... B01D 45/00; F22B 37/26

[52] U.S. Cl. ..... 122/491; 55/444; 55/344; 55/347; 55/440

[58] Field of Search ..... 122/488, 489, 491, 492; 55/342, 344, 347, 440, 444

[56] References Cited

U.S. PATENT DOCUMENTS

| | | | |
|---|---|---|---|
| 1,992,824 | 2/1935 | Hackett | 122/491 |
| 3,370,574 | 2/1968 | Hohnholt | 122/491 |
| 3,572,015 | 3/1971 | Brunner | 55/347 |
| 3,735,569 | 5/1973 | Micheller et al. | 122/488 |
| 3,850,599 | 11/1974 | Calkin et al. | 55/440 |
| 3,923,010 | 12/1975 | Chlique | 122/491 |

FOREIGN PATENT DOCUMENTS 2254092 8/1977 France .

*Primary Examiner*—Henry C. Yuen

*Attorney, Agent, or Firm*—Pollock, Vande Sande & Priddy

[57] ABSTRACT

A modular drying unit for a steam generator, having identical dryer elements arranged partly as a polygonal crown within the envelope of the generator and partly as a star within that crown. The dryers constitute in trios triangular cells the inner space of which is divided by a partition permitting isolation of the dryers with respect to one another, as well as guidance of the steam at the intake and outlet ends of the dryers. This type of unit is particularly suitable for generators with natural circulation, notably for a nuclear reactor.

6 Claims, 6 Drawing Figures

2
8
16
B
A
17
18
7
V
V
6
5
E
1
E
4
3

DRYING UNIT FOR A STEAM GENERATOR ESPECIALLY IN NUCLEAR REACTORS

FIELD OF THE INVENTION

The present invention relates to a drying unit for the water-steam separating equipment located in the top portion of a natural flow steam generator, i.e., downstream of the steam production. The drying unit according to the invention is designed in particular to assure the separation of the steam in a steam generator associated with a nuclear reactor, although this application is in no way limiting.

PRIOR ART

It is known that natural flow steam generators include water-steam separating equipment in order that the steam produced by the tube cluster (or by the fuel elements in the case of boiling water reactors) may be as dry as possible at the outlet of the generator. In general, such separating equipment includes two units arranged in series in the direction of flow of the steam, these units being essentially distinguished by the amount of water that they can trap. A first unit, or primary separator unit, is intended to remove from the steam the major part of the water to be separated, while the second unit, or drying unit, enables the trapping of some particles of water which may still be entrained by the steam downstream of the primary separator unit.

It is such a drying unit to which the present invention particularly relates.

Drying units are already known which permit the steam coming from primary separators to be well dried, notably through French Pat. No. 2,275,731. This document describes a separating apparatus in which the drying unit (called in the patent a second moisture separator) is constituted by two groups of chevron-shaped separators arranged one above the other, the intake of the steam to be dried occurring through the periphery and its output through the central zone.

Also, French Utility Certificate No. 2,254,092 describes a separator unit formed by drying frames constituting either a bed of several concentric crowns or a radiating structure, a pipe arrangement being provided at the base of the frames to collect and drain off the water collected. Such arrangements are adapted to boiling water reactors.

Lastly, two other known arrangements should be noted of driers at the upper part of boiling water reactors, namely, the bed arrangement of parallel vertical frames separated by slightly inclined or curved deflecting metal sheets and the bed arrangement of vertical frames and parallel deflecting sheets slightly inclined to the vertical having the appearance of house roofs constructed directly side by side, this latter arrangement being described in French Pat. No. 1,554,253.

All these known devices offer acceptable drying efficiency locally, but they do not permit easy construction of the drying unit from a small number of parts and lead to a poorly optimized ratio between the installed space and the available exchange surface, and consequently a low efficiency which necesitates, for improvement, an increase in the volume, hence in the weight of the arrangement and in the bulk of the steam generator.

SUMMARY OF THE INVENTION

It is an object of the present invention to provide a drying unit which eliminates these drawbacks by permitting modular construction and by assuring considerable available exchange surface in as small an overall space as possible.

It is another object of the invention to provide a drying unit which permits a gain in volume to be realized at the level of the pressure envelope of the generator, which permits its design to be adapted more strictly to the optimal conditions of thermohydraulic operation.

It is a further object of the invention to provide a drying unit which assures distribution and organization of the steam circulation which favors particularly efficient use of the cross-section offered within the steam generator, as well as improvement in the operation and hence in the efficiency of separation.

In the manner disclosed in French Pat. No. 2,254,092, the drying unit of the invention comprises a plurality of drying elements, steam guidance means organizing the intake of moist steam into the drier elements and the output of dry steam from the drier elements and devices for collecting the separated water associated with the drying elements. The drying unit according to the invention is distinguished by the fact that it has a modular structure, all the drying elements being identical and distributed in a ternary symmetry of revolution and that, in a first series of drier elements, said elements are arranged radially and associated with steam guidance means which provide alternately around the axis of revolution a dry steam output space from one element and a moist steam intake space in the succeeding element, the intake spaces each occupying in a lower transverse section of the unit a surface identical with that occupied by each of the output spaces in an upper transverse section of the unit.

The drying unit of the invention may advantageously include one or several concentric series of identical drying elements arranged radially, as has just been defined, and in addition one or several series of drying elements constituting an annular peripheral crown, wherein the elements of parallelepipedic shape and preferably identical with the drying elements that they encircle, are arranged along the sides of a polygonal shape, each extending from the end of one radial element to the following radial element of the same series. Preferably the guidance means for the steam associated with the drying elements of the second series provide for each an intake space situated radially outside of the element, between the latter and a cylindrical enclosure, and on the other hand an output space situated radially inside the element, while, for the drying elements of the first series, the intake spaces in one element and the steam output from the element are distributed alternately around the axis of revolution of the unit. In this way a very homogeneous distribution of the path of the steam is obtained through the drying elements over the whole of the top portion of the generator.

Advantageously, in a preferred embodiment of the invention, each element of the second series forms with two elements of the first series a triangular shaped cell whose three sides are constituted respectively by the three drying elements.

To assure the guidance of the steam and distribute it as equally as possible between the drying elements, the inner space of each cell is advantageously divided by a partition isolating the drying elements from one another and comprising three vertical plates extending along a portion of each of the bisector planes of the cell and fixed to one another along a contact axis at the center of the cell, so as to define three equal compartments, and on the other hand three transverse plates comprising two lower plates closing the base of two compartments respectively and an upper plate closing the top of the third compartment.

The best conditions of operation are generally obtained when the cells are arranged in the drying unit so that the drying element adjacent to one of the compartments closed by a lower plate constitutes an element of the peripheral crown. With cells of identical equilateral triangles as has been defined, the drying unit is bounded by drying elements defining a hexagon. If necessary, identical hexagons can be combined to occupy a larger overall transverse cross-section.

Advantageously, the drying unit according to the invention comprises water collecting devices opening into ducts oriented parallel with the axis of symmetry arranged at the outer radial end of each of the elements of the first series, said ducts serving equally for collecting water separated in the drying elements of a second series, and the guidance means include an annular tray bounding a moist steam intake space in the drying elements of the peripheral crown and extending between a cylindrical outer enclosure and the top of each of the elements of the second series.

BRIEF DESCRIPTION OF THE DRAWINGS

A preferred embodiment of a drying unit according to the invention will now be described with reference to the accompanying drawins, in which.

DETAILED DESCRIPTION OF AN EMBODIMENT

Figure 1:
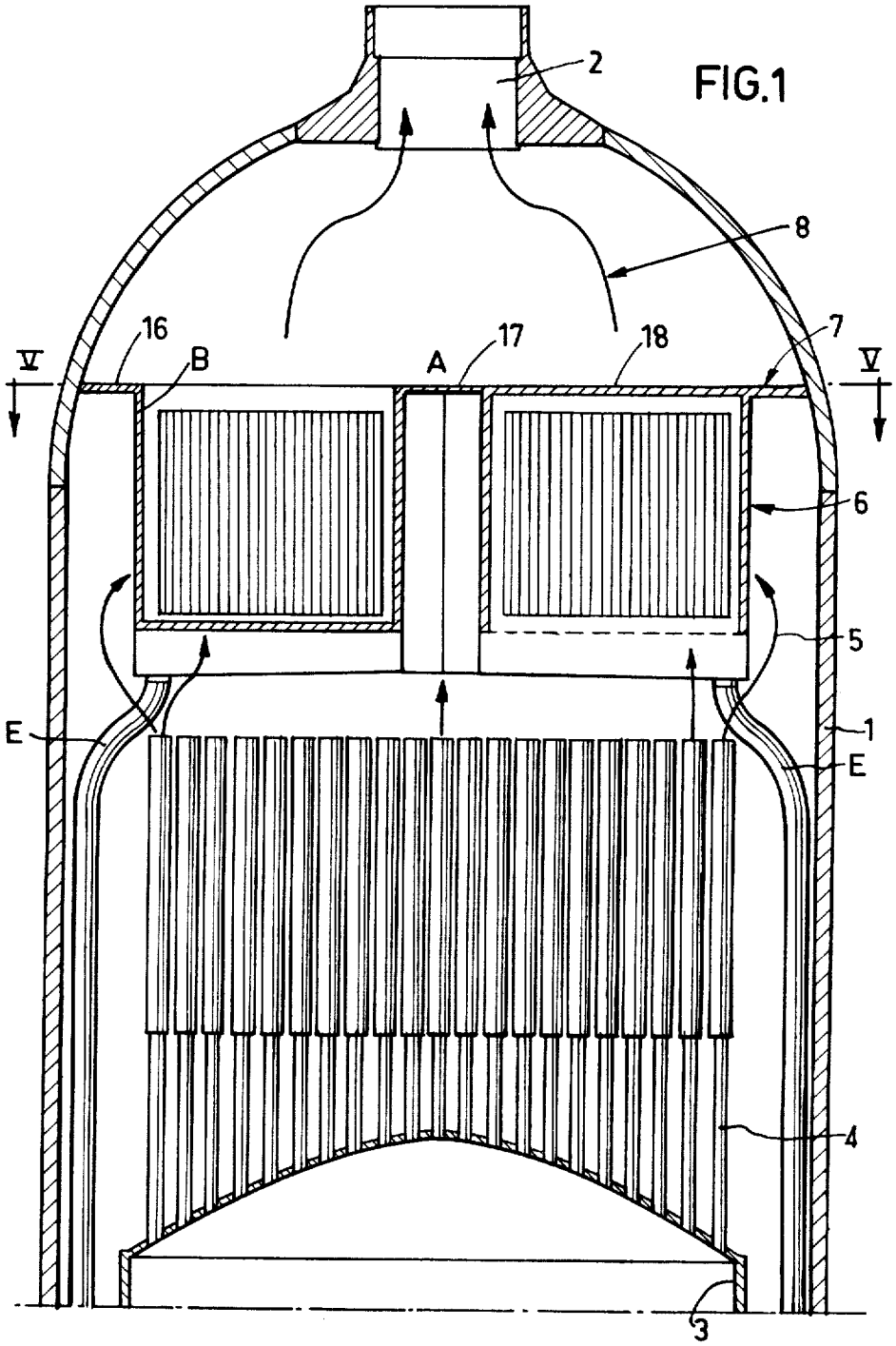
FIG. 1 is a diagrammatic view in vertical section of the top part of a steam generator equipped with an embodiment of a drying unit according to the invention.

Diagrammatically shown in FIG. 1 is shown the outer envelope of a steam generator whose dome-shaped top includes an orifice 2 for the outflow of the steam produced. At 3 is shown the steam production chamber housed in the bottom portion of the envelope 1 and in which is installed the traditional tube bundle, (not shown) in which flows a primary fluid and which assures the vaporization of the secondary fluid (namely water) contained in the chamber 3. The steam escapes from the chamber 3 by traversing a water-steam separator 4 of conventional construction and assuring the collection of the major portion of the water entrained by the steam as well as its return to the chamber.

The steam emerges from the separator 4 along the arrows 5 with a flow distributed almost uniformly over the whole transverse section of the generator and at a homogeneous speed.

It can still contain fine droplets of water in suspension, of which droplets the drying unit according to the invention, denoted generally at 6, assures the collection and return through pipes E to the lower part of the generator. The drying unit 6 is hence, to this end, located downstream of the separator 4 and the steam 8 emerging from this unit 6 possesses a humidity compatible with the good operation of equipment utilizing this steam. It will be noted that the space of the generator located downstream of the drying unit is isolated from the rest of the generator by a separator tray denoted generally as 7 and of which the construction, which will be described in detail below is such that it obliges the "wet" steam to pass through the drying unit 6 before reaching the discharge orifice 2, which is situated above the drying unit, substantially on its axis.

The drying unit 6 will now be described in more detail with reference to FIGS. 2 to 6. As is seen particularly from FIGS. 2 and 5, the drying unit is constituted by drying elements 9*a* and 9*b* of parallelepipedic shape and all identical, associated with partitions which assure the guidance of the steam flowing vertically, from below upwards, through the drying elements. The latter are distributed in a ternary symmetry of revolution around the axis of the unit, so as to form a modular structure with six modules in the particular case shown. In the group of elements, two series are distinguished. In the first series the elements 9*a*, six in number in the example concerned, are arranged radially so as to form a radiating star centered on the axis of the enclosure. The second series constitutes a peripheral crown of annular shape around the first. The drying elements 9*b* are arranged therein, vertically like the first ones, each of a side of a polygonal section, here hexagonal, and extending between one end of a radial element and the end of the following radial element.

Figure 6:
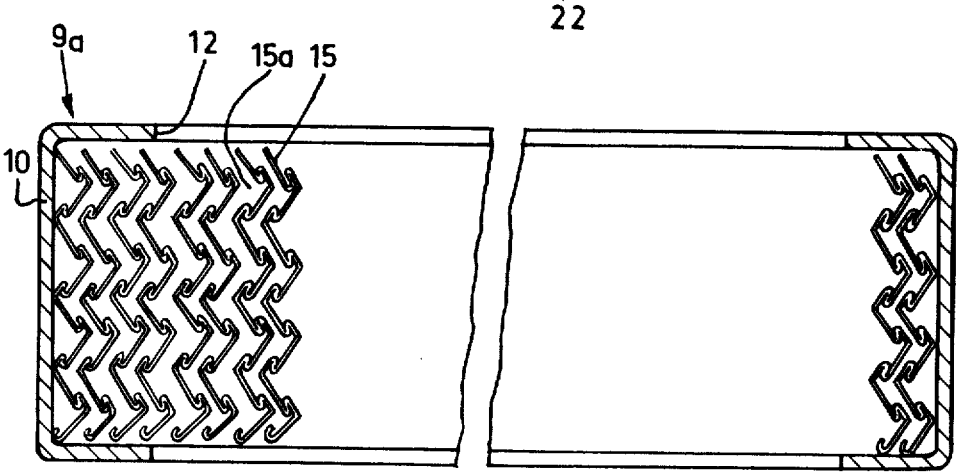
FIG. 6 is a section on a larger scale of a drying element along the line VI—VI of FIG. 4.

The drying elements have a conventional structure such as that which is shown in FIG. 6 by way of example, constituted by a rectangular peripheral frame 10 with an open U-shaped cross-section at 11 and 12 on the two opposite large surfaces and filled by a stack of lamellae or chevron-shaped elements 15 forming staggered passages 15*a* allowing the passage of the steam through the frame. These lamellae are arranged vertically so that the water droplets which are deposited on them can slip down to the base of the frame 9 in which is arranged a drainage channel 14 located beneath a perforated plate 13 supporting the lamellae 15.

The assembly of drying elements is supported by the separator tray 7 to which they are fixed, said tray 7 being itself fixed to the envelope 1 by any suitable means (not shown).

Figure 5:
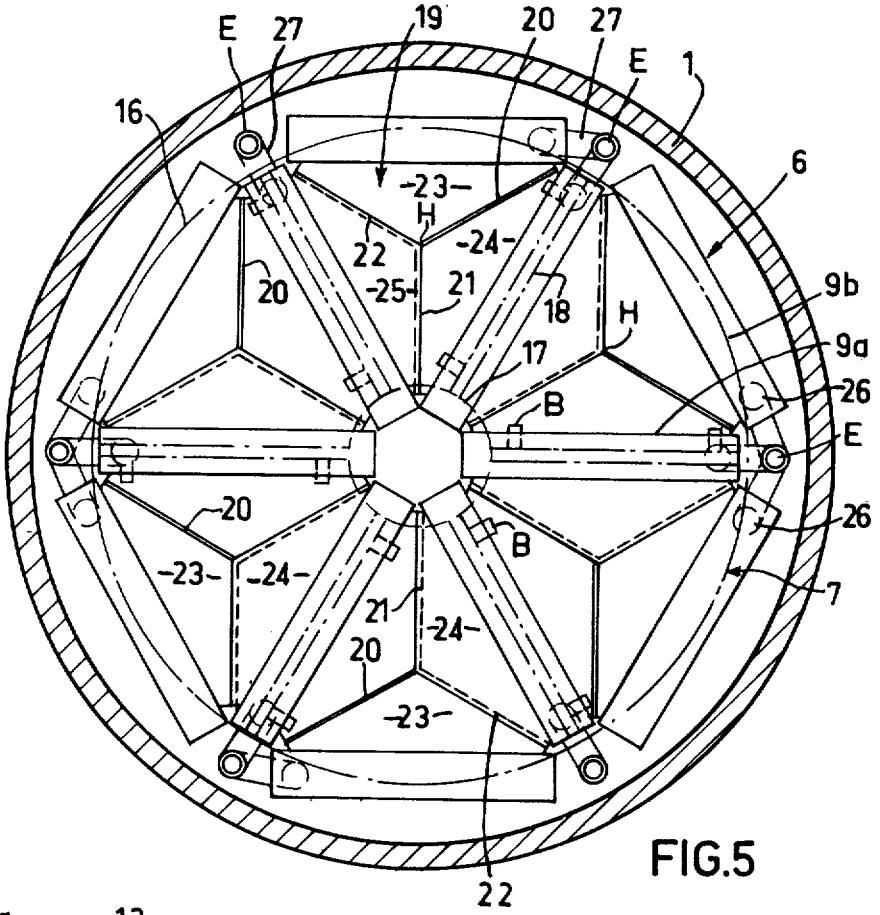
FIG. 5 is a section view along the line V—V of FIG. 1.

The separator tray 7 has been shown in mixed lines in FIG. 5. It includes an annular external part 16 to which are fixed the drying elements 9*b* of the peripheral crown, this external part 16 obturating the intervals situated between the cylindrically shaped envelope 1 and the driers which occupy a rectangular section, each on a side of the polygon. The tray 7 also includes a central part 17, connected to the part 16 through radial webs 18 extending advantageously along the length of the driers 9*a* to which they are fixed; the central part 17 assures the closing of the top of the central space left free between the ends of the driers 9*a*. The fastening of the drier to the plate 7 can be completed if necessary by vertical frames B (see FIGS. 1 and 5) fast to the tray 7 and to which are fixed the faces of the driers 9*a* through which the dry steam emerges from the drier to reach the space situated above the tray 7, as will be explained below.

Figure 2:
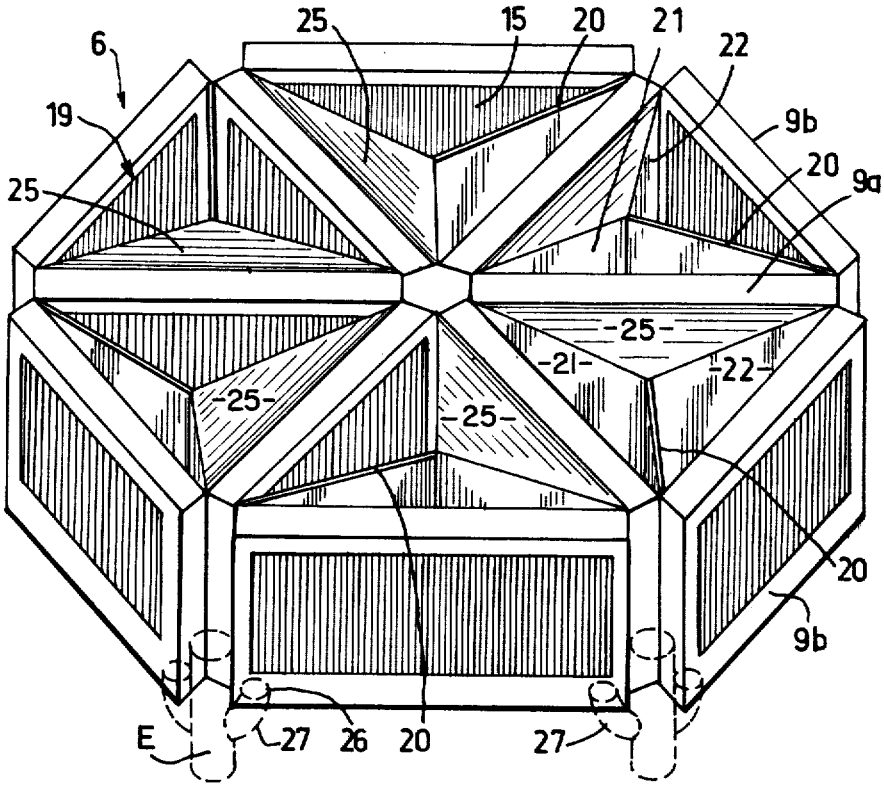
FIG. 2 is a perspective view of the drying unit of FIG. 1, showing only the triangular modules, or cells.

As is seen from FIGS. 2 and 5, each drier 9*b* constitutes with two consecutive radial driers 9*a*, a cell denoted generally at 19 (FIG. 5), and having a generally equilateral triangle shape.

The inner space of each cell 19 is divided by a partition whose purpose is to effect the isolation of each drier 9*a* or 9*b* with respect to the others. This partition comprises three vertical plates 20, 21 and 22, which extend respectively from the center of the cell along each of the bisectors of the angles of the top of the cell, these plates being fastened along their common contact line H (FIG. 5) and bounding three equal compartments in the cell. The partition is completed by two lower rectangular plates 23 and 24 and one upper triangular plate 25.

Figure 3:
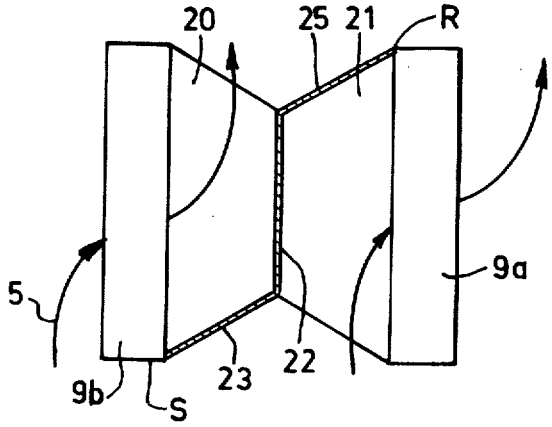
FIG. 3 is a detailed view showing the internal partitioning of a cell.

In each cell, the lower plate 23 closes the lower base of the compartment adjacent to the peripheral drier 9*b* and it is connected to the lower edge S of the latter and to the lower edges of the vertical plates 20 and 22, while the lower plate 24 closes in the same way a compartment adjacent to one of the radial driers 9*a* by being connected to the lower edge of the latter and to the lower edges of the vertical plates 20 and 21 (see FIG. 3). As for the upper triangular plate 25, it closes the top part of the third compartment of the cell and it is connected to the upper edge R of the second radial drier 9*a* and to the upper edges of the vertical plates 21 and 22 (FIG. 3).

Figure 4:
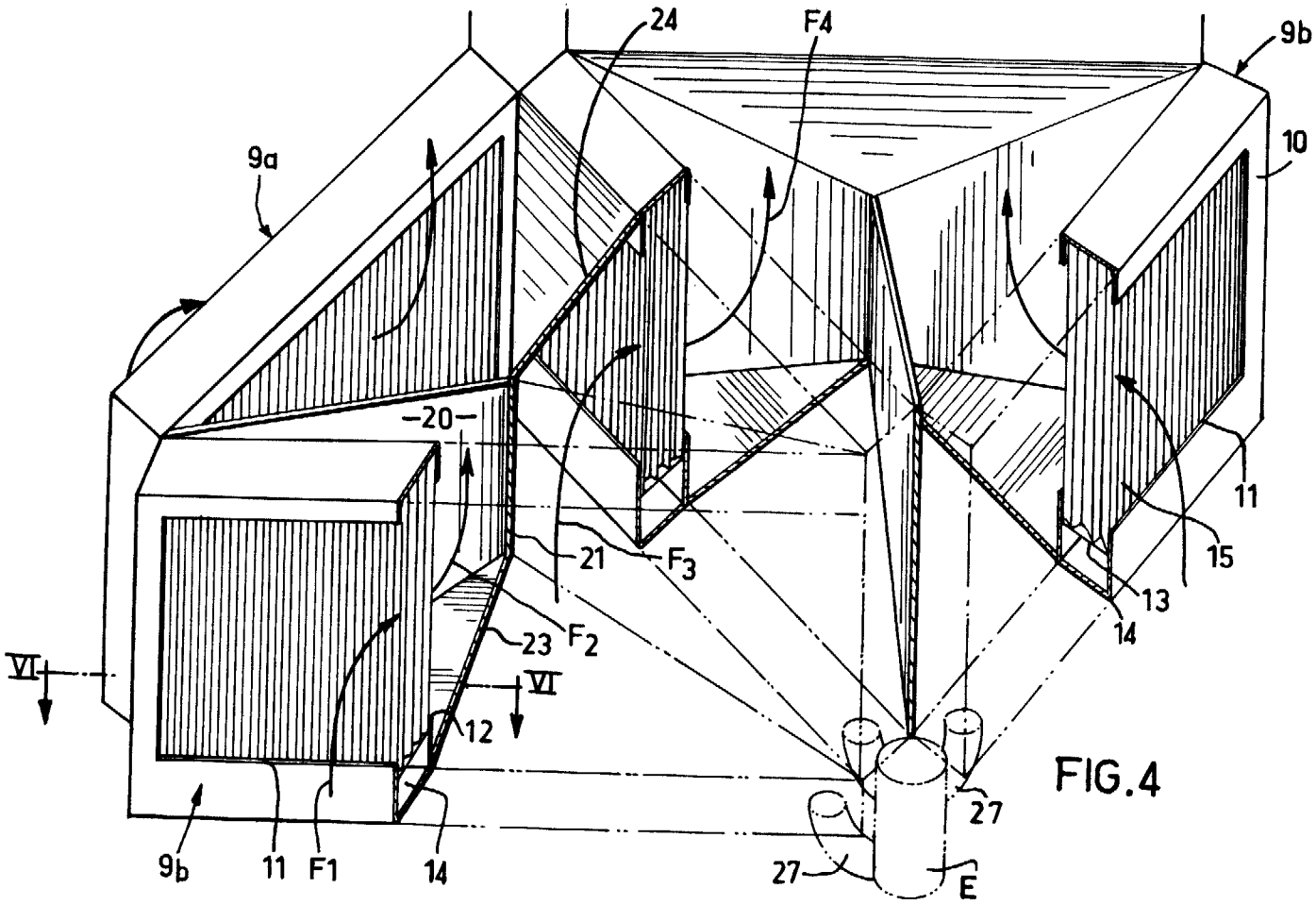
FIG. 4 is a partial perspective view on a larger scale and with parts torn away, illustrating the flow of the steam through the drying elements of two adjacent cells.

By such an arrangement of the partitioning, as is seen particularly in FIG. 4, the wet steam is obliged to be distributed homogeneously between the driers and to traverse each of the latter in a well-determined direction. Thus, the steam rising to the periphery of the drying unit, i.e., between envelope 1 and the driers 9*b* and arrested by the part 16 of the support tray 7 of the drying unit, penetrates into the driers 9*b* in the direction of arrows $F_1$ of FIG. 4, radially from the outside inwardly, and it emerges therefrom in the direction of arrow $F_2$ through the compartment bounded by the vertical plates 20 and 22 and the lower plate 23, this compartment being open at its upper part to permit the steam to reach the discharge orifice 2. In the central part of the drying unit, the steam can have free access to the radial driers 9*a* through the intake compartments bounded by the vertical plates 21 and 22 and closed at their tops by the upper plates 25. The steam in hence forced to traverse the driers 9*a* along the arrows $F_3$ (FIG. 4) and it emerges therefrom through the output compartments bounded by the vertical plates 20 and 21 closed at their base by the plate 24 but open at their top part to enable the steam to rise in the direction of arrow $F_4$ toward the discharge orifice 2.

Preferably, as is seen in FIGS. 3 and 4, the lower 23 and upper 25 plates are slightly inclined in order to facilitate the guidance of the steam.

The contact axis of the three vertical plates of the partitioning, at H, only extends over a part of the height of the cell, in its middle part.

The removal of the water collected in the driers 9*a*–9*b* is effected as has already been stated through pipes E communicating with the bottom part of the generator, the water collecting tanks 14 located at the base of the driers being connected to these pipes E through pipes 27 open at an orifice 26 formed in the bottom of the tanks 14. Pipes E can be provided between each pair of driers 9*b* according to the arrangement shown in FIG. 5, in the spaces left free at the corners of the polygonal shape between the lateral faces of the parallelepipedic drying elements. FIG. 4 thus shows a collector pipe E gathering the water separated in a radial drier element and two adjacent peripheral drier elements, belonging therefore to two different cells of the modular structure.

What is claimed is:

1. Steam drying unit comprising a plurality of vertically disposed drying elements of parallelepipedic shape, each of said drying elements being provided with steam guidance means for the admission of wet steam into said drying element, and means for collecting the water gathered in said drying element, a number of said peripheral drying elements comprising an annular crown, the remainder of said drying elements being radially disposed at the interior of said crown, with each of said radial elements extending from a corner on said crown toward the center of said crown and forming with two of said radial elements a triangular cell, said guidance means comprising, for each said cell, an inner partition comprising three vertical plates, extending over a portion of each of the bisector plates of said cells and fixed to one another along a contact axis at the center of said cell, so as to define therein three equal compartments, and three transverse plates comprising two lower plates closing the base of two compartments, respectively, and an upper plate closing the top of the third compartment.

2. Drying unit according to claim 1, wherein said guidance means associated with said drying elements of said crown provide for each an intake space situated radially outside of said element, between the latter being a cylindrical vessel, and an output space situated radially inside said element.

3. Drying unit according to claim 1, wherein said cells are so arranged that the drying element adjacent to one of the compartments closed by a lower plate constitutes an element of said peripheral crown.

4. Drying unit according to claim 1, wherein the contact zone between said vertical plates extends axially over a middle portion only of the height of said cell, and wherein said transverse plates are inclined between said contact zone and either the base or the top of the adjacent drying element.

5. Drying unit according to claim 1, wherein said guidance means comprise an annular plate bounding a wet steam intake space in said peripheral elements and extending between a cylindrical outer enclosure and the top of each of said peripheral elements.

6. Drying unit according to claim 1, wherein said water collecting means open into ducts parallel to the axis of symmetry and located at the outer radial end of each of said radial elements, said ducts serving also for collecting the water separated in the drying elements of said peripheral elements.

* * * * *